United States Patent [19]

Taguchi

[11] 4,035,160

[45] July 12, 1977

[54] METHOD FOR MANUFACTURING A CONVEX OR CONCAVE LAPPING TOOL

[75] Inventor: Shinji Taguchi, Tokyo, Japan

[73] Assignee: Canon Kabushiki Kaisha, Tokyo, Japan

[21] Appl. No.: 650,977

[22] Filed: Jan. 21, 1976

Related U.S. Application Data

[63] Continuation of Ser. No. 484,102, June 28, 1974, abandoned.

[30] Foreign Application Priority Data

July 4, 1973 Japan ..... 48-75525

[51] Int. Cl.$^2$ ..... C09K 3/14; B29C 1/02

[52] U.S. Cl. ..... 51/295; 51/298 A; 51/309 R; 264/226

[58] Field of Search ..... 51/298, 293, 309, 308, 51/307, 295; 264/225, 219, 226, 248, 250

[56] References Cited

U.S. PATENT DOCUMENTS

| | | | |
|---|---|---|---|
| 2,472,060 | 6/1949 | Beylerian | 264/226 |
| 2,651,079 | 9/1953 | Michaelson et al. | 264/219 |
| 3,294,888 | 12/1966 | Lindahl | 264/248 |
| 3,594,963 | 7/1971 | Beasley | 51/293 |
| 3,657,845 | 4/1972 | Sekiya | 51/298 |

*Primary Examiner*—Donald J. Arnold
*Attorney, Agent, or Firm*—William R. Woodward

[57] ABSTRACT

A lapping tool for grinding or polishing glass such as optical lens having exact curvature with the lens to be worked is manufactured by pouring a liquid resin into a mold having incompatability with the liquid resin at a portion corresponding to pellets to be adhered onto a blank dish body, and then hardening the resin in the mold, while the blank dish body is being press-contacted against the mold surface thus, molding the pellets onto the tool blank. The mold is shaped to a precise curvature of the lens to be worked by means of a master lapping tool equipped with lapping pellets.

6 Claims, 5 Drawing Figures

METHOD FOR MANUFACTURING A CONVEX OR CONCAVE LAPPING TOOL

This is a continuation of application Ser. No. 484,102, filed June 28, 1974 and now abandoned.

BACKGROUND OF THE INVENTION

1. Field of the Invention

This invention relates to a method for manufacturing a lapping tool to be used for grinding or polishing glasses such as optical lenses, and so on. More particularly, it is concerned with the manufacture of the lapping tool, in which small pieces of plastic sheets, or pellets, are adhered onto the surface of a cast iron dish, etc.

2. Description of the Prior Art

Heretofore, lapping of an optical lens has been performed in such a way that the lens is first subjected to a grinding work by means of a lapping dish produced by adhering diamond pellets onto the surface of a cast iron tool, and subsequently to polishing work by means of a polishing tool produced by adhering pitch or a plastic sheet for polishing onto the surface of the cast iron tool, while a polishing liquid [an aqueous solution of cerium oxide ($CeO_2$) or zirconium oxide ($ZrO_2$)] in the main is being fed into a sliding surface between the lens and the polishing dish.

The polishing tool to be used for the above-mentioned purpose has heretofore been manufactured in the following manner. A foam controlling agent is first added to liquid polyurethane elastomer, and the batch is agitated at a high speed with addition, if necessary, of cerium oxide ($CeO_2$) or zirconium oxide. Subsequently, a hardening agent molten at 120° C is added to this elastomer and mixed uniformly, followed by heating at a temperature of 100° C, to obtain foamed polyurethane in block shape. Then, this foamed polyurethane block is cut into a sheet of an appropriate thickness, after which the sheet is cut into pellets of a desired sheet. The pellets are then adhered onto the surface of a cast iron tool body, etc. by an adhesive agent to produce the complete lapping tool.

In the conventional method of manufacturing the lapping tool as described in the preceding, a considerably long time is required for the complete preparation of the lapping tool. That is to say, the number of the pellets to be adhered onto the lapping tool often amounts to from 70 to 200 pieces, the accurate adhesion of which onto the lapping dish necessitates considerable time and skill. Further, since the pellet surface is flat, while the surface of the lapping tool is curved, a greater quantity of the adhesive agent is required to be used for the pellets for complete adhesion on the curved tool surface, which has presented a problem. Furthermore, since the pellet-adhered lapping tool as so made does not always same have the surface curvature as that of the lens to be made, it has been unavoidable that the curvature of each lapping tool has had to be checked and corrected by a curvature correcting tool.

SUMMARY OF THE INVENTION

It is therefore an object of the present invention to provide a method for manufacturing the lapping tool for grinding or polishing the optical lenses which overcomes the defects in the heretofore known method of manufacturing the lapping tool as above described.

It is another object of the present invention to provide an improved method of manufacturing the lapping tool, wherein the working steps of cutting a plastic sheet into pellets, and sticking the pellets onto a cast iron tool body by means of an adhesive agent are completely dispensed with.

It is still another object of the present invention to provide a method of manufacturing a lapping tool for grinding or polishing of glass having a consistent and accurate quality.

It is other object of the present invention to provide a method for manufacturing a lapping tool, in which the pellets are strongly adhered to the cast iron tool body without use of any adhesive agent whatsoever.

It is still another object of the present invention to provide a method for manufacturing a lapping tool having an accurate curvature, wherein the pellets, each having the same curvature as that of the curved surface of the lapping tool, are bonded thereonto, and the shape of the pellets is controlled simultaneously with the manufacture of the completed tool.

It is a further object of the present invention to provide a method for manufacturing a lapping tool, wherein the final treatment process of polishing the surface of the lapping tool by a curvature correcting tool to correct the curvature of the lapping tool provided with pellets thereon is not required.

According to the present invention, there is provided a method for manufacturing a lapping tool for grinding or polishing glass which comprises steps of: providing a mold made of a material which does not have adhesive property with regard to the pouring liquid resin used for pellet formation at least after hardening of the resin, said mold being in the relationship of concave and convex with a master lapping tool used to shape the original mold and having provided thereon a plurality of pellets; pouring the liquid resin into said mold in a quantity sufficient to fill up the pellet portions therein; hardening the thus filled-up pouring liquid resin against a blank tool body corresponding in size and shape to said mold and yet to be provided thereon with the pellets, the blank tool body being press-contacted against the mold surface: and finally separating the lapping tool from the mold upon hardening of the liquid resin.

The liquid resin is selected from liquid epoxy resin, liquid polyurethane resin, liquid acrylic resin, or liquid polyethylene terephthalate resin.

One preferred material for the mold is rubber.

Metals are also suitable materials for the mold, and when metals are used at least the portions in the mold corresponding to the pellets are coated with a mold separating agent.

The foregoing objects and the actual way of manufacturing such a lapping tool according to the present invention will be more readily understood from the following detailed description, when read in connection with illustration of several preferred examples thereof in the accompanying drawing.

DETAILED DESCRIPTION OF THE INVENTION

The liquid casting resin which can be adopted for use in the method of the present invention may be any kind of conventional pouring resin having appropriate adhesive and polishing properties with respect to a cast iron tool body. Particularly suitable liquid resins for the purpose of the present invention are, for example, liquid epoxy resin, liquid polyurethane resin, and liquid acrylic resin, liquid polyethylene terephthalate resin.

The material for the mold to be used in the present invention may be any kind that does not allow adhesion of the abovementioned pouring liquid resin when it becomes hardened. A preferred example of such a material is silicone rubber. In addition, a metal material such as aluminum, the surface part of which has been coated with a silicone type mold separating agent or tetrafluoroethylene (TFE) for the purpose of providing a non-stick mold surface finish may be used.

The manufacture of a lapping tool according to the present invention will be described hereinbelow with more particularity in reference to the accompanying drawing.

First of all, manufacture of the mold for use in the present invention will be explained in reference to FIGS. 1 and 2. As shown in FIG. 2, a master lapping tool 1, on which pellets 2 are adhered in conformity to the surface curvature of a lens to be obtained is first manufactured. Next, this master lapping tool 1 is secured firmly by a holder and stand (not shown), and is set at the center part of a mold frame 4.

Figure 1:
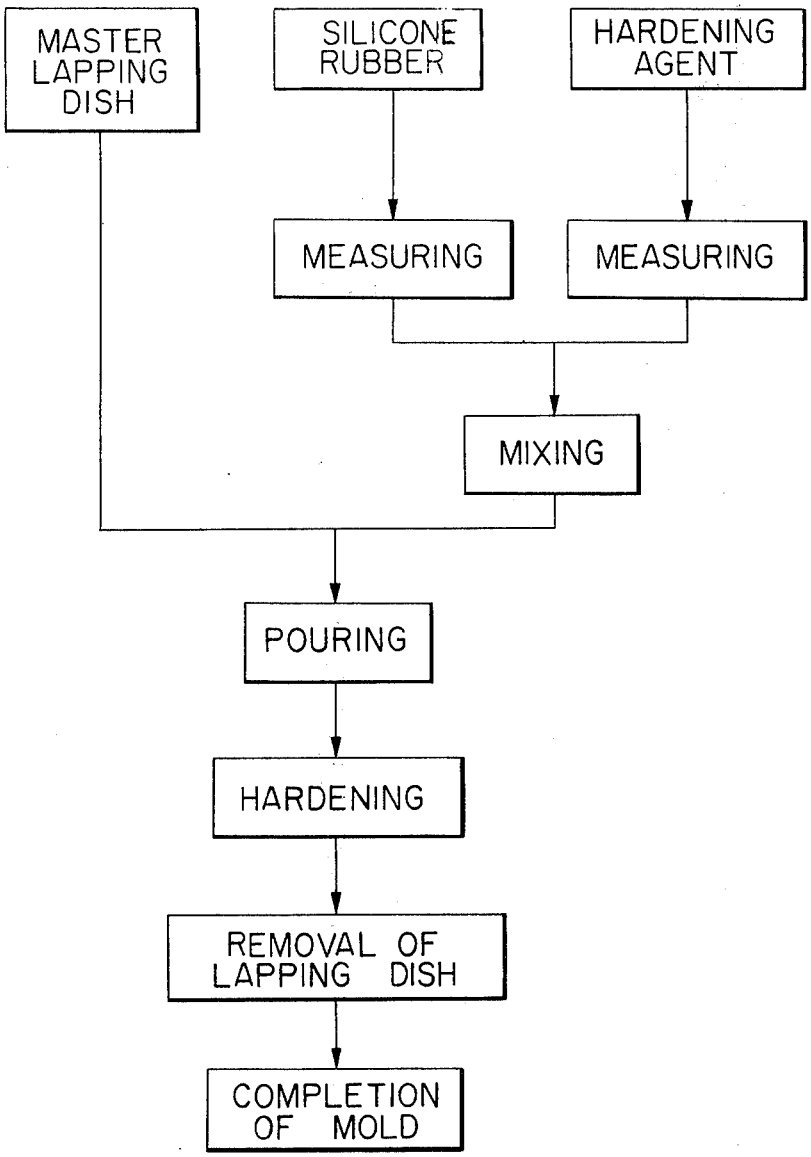
FIG. 1 is a flow-sheet showing the processes for obtaining the mold of silicone rubber to be used for manufacturing the lapping tool according to the present invention.
Figure 2:
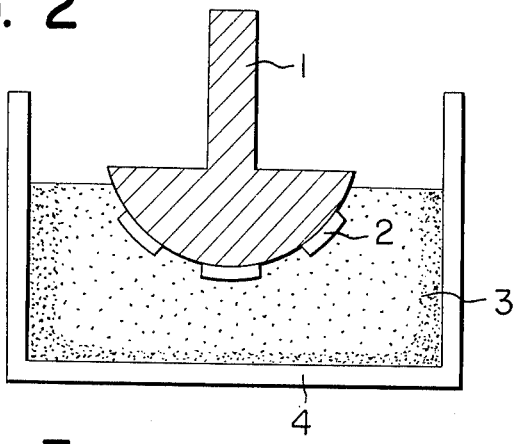
FIGS. 2 and 3 are respectively explanatory diagrams showing production of the lapping tool according to the method of the present invention.

Subsequently, as shown in FIG. 1, silicone rubber and a hardening agent in measured quantities are uniformly mixed and poured into the mold frame 4, and allowed to harden therein for about one hour at a normal temperature or an elevated temperature of about 70° C, for example. Upon verification of sufficient hardening, the master lapping tool is removed from the mold, whereby the silicone rubber mold 3 is obtained.

When the mold is thus formed, a liquid pouring resin is poured into the mold at the place corresponding to the pellets portion 2 of the mold 3, and a blank body for the lapping dish is then placed in the mold in a manner to press against the mold surface to thereby harden the pouring liquid resin, thereafter the lapping tool is removed from the mold. In this way, the lapping tools identical with the master lapping tool can be produced easily, accurately, and in a large quantity.

Figure 3:
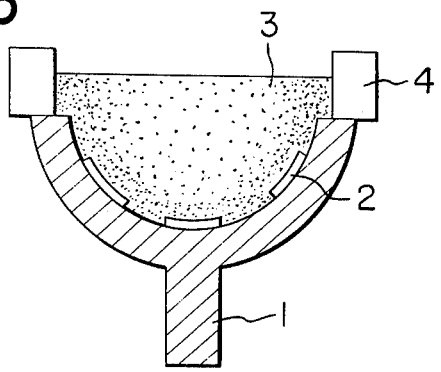

FIG. 3 shows one example of producing a concave lapping tool, in contrast to the convex lapping dish of FIG. 2. In FIG. 3, the mold 3 is manufactured in substantially the same procedure as mentioned above, and the lapping tool 1 provided thereon with the pellets 2 is obtained.

Figure 4:
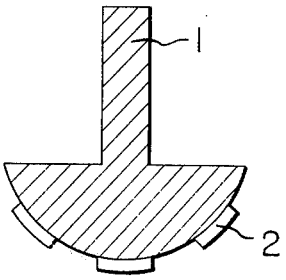
FIG. 4 shows one example of the lapping tool manufactured in accordance with the method of the present invention.

FIG. 4 indicates one example of the lapping tool obtained by the manufacturing method according to the present invention, which consists of a tool body 1 and pellets 2 of a pouring liquid resin as hardened and adhered onto the surface of the tool body 1.

Figure 5:
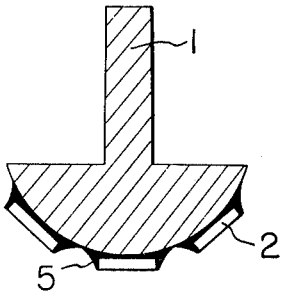
FIG. 5 shows a lapping tool manufactured by the conventional method, wherein the pellets are adhered onto the dish by an adhesive agent.

FIG. 5 shows the lapping tool manufactured by adhering the pellets 2 onto the tool body 1 with an adhesive agent 5 as in the conventional method.

As will be apparent from comparison of the lapping tools shown in FIGS. 4 and 5, the lapping tool maufactured by the method of the present invention as shown in FIG. 4 has the pellet surface of the same curvature as that of the lens to be worked, since the surface curvature of the tool body 1 and that of the pellets are quite naturally same, hence the adhesion therebetween can by accomplished without difficulty. Accordingly, the lapping tool manufactured in accordance with the present invention does not generally require polishing of the pellet surface thereof with a correcting dish. In contrast to this, the lapping tool produced in accordance with the conventional method as shown in FIG. 5 has a flat pellet surface as against the curved surface of the tool body as seen from FIG. 5, so that a large amount of the adhesive agent needs be used to fill up the discrepancy between the flat pellet surface and the curved tool body surface, hence difficulty in adhesion therebetween. Moreover, in order to bring the pellet surface of such lapping tool to the same curvature as the curved surface of the lens to be obtained, the pellet surface thereof should be sufficiently polished by a correcting tool.

Further, in the conventional method, considerably long time and high skill are required to accurately and precisely adhere the pellets onto the tool surface, while, in the present invention, once the master lapping tool is manufactured precisely at the outset, identical lapping tools can be produced thereafter in a short period of time with high accuracy and in a large quantity by very simple production operations.

Preferred Examples

With a view to enabling persons skilled in the art to practice the present invention, the following preferred examples are presented. It should, however, be noted that the present invention is not limited to these examples only, but changes and modifications in the materials and their quantities as well as the treating conditions may be made within the ambit of the present invention as set forth in the appended claims.

EXAMPLE 1

A master lapping tool with pellets of circular contour and of the same curvature as that of a lens to be obtained adhering onto the tool surface was first produced. Each circular pellet was 7mm in diameter and 1.5 mm in thickness. The number of the pellets provided on the tool surface was 13 pieces.

This master lapping tool was hung in a frame for a rubber mold. Then, a mixture of 20g of silicone rubber (product of Shinetsu Kagaku Kogyo K. K., Japan sold under a trade name "1300RTV") and 2g of a hardening agent (a product of Shinetsu Kagaku Kogyo K. K., Japan sold under a trade name "CATALYST 1300") was poured into the mold frame, and hardened at a temperature of about 70° C for one hour. Upon sufficient hardening of the rubber mold, the master lapping tool was removed from the mold, whereby the intended mold could be obtained.

Next, 13g of liquid epoxy resin (a product of Dai-Nippon Shikizai Kogyo K. K., Japan sold and a trade name "PRIEPOH PE-10") and 1.3g of an amine type hardening agent (a product of Dai-Nippon Shikizai Kogyo K. K., Japan sold under a trade name "T.T.A.")

were sufficiently mixed by agitation, after which the liquid resin was poured into the silicone rubber mold at places corresponding to the pellets portion thereof. While the liquid resin was still in the fluid state, a blank tool body of cast iron having the same curvature as that of the master but not having pellets adhering thereon was placed in the mold in a manner pressing against the mold surface from above. In that state, the mold was kept in an isothermal chamber maintained at a temperature of 60° to 70° C for 15 minutes to harden the epoxy resin. After sufficient hardening of the resin, when the tool body was removed from the mold, a lapping tool identical with the master lapping tool and having the epoxy resin adhering onto the tool surface in the pellet form was obtained. Although it was almost unnecessary to correct the curvature of this lapping dish, it was still polished for about 15 seconds by a correcting tool of cast iron to correct its curvature to the most precise degree. In contrast to this, the lapping tool, on which pellets of epoxy resin of 7 mm in diameter and 1.5 mm in thickness were made to adhere by first applying an adhesive agent, had a curvature so different from that of the lens to be polished, that it had to be polished for about 3 minutes by a correcting tool to correct the curvature into conformity to that of the lens.

The above-described lapping tool according to the present invention was subjected to lens polishing under a load of 4 Kg/cm² at a varying speed ranging from low (10 rpm) to high (3000 rpm). No peeling off of the pellets was observed at all, and satisfactory polishing could be achieved.

In place of "PRIEPOH PE-10" as used above, "CASTALL 301" (a trade name for a product of K. K. Ryosan Boeki, Japan) has been used as the liquid epoxy resin. Also, in place of T.T.A. as the hardening agent, "E-34 (a trade name for a product of K. K. Ryosan Boeki, Japan) has been used. Substantially same results were obtained from the pellets of this epoxy resin.

EXAMPLE 2

A master lapping tool having the same curvature as that of a lens to be obtained was first manufactured precisely. The pellets were in circular form, each having a diameter of 20 mm and a thickness of 3 mm. The number of the pellets was seventy pieces.

The master lapping tool was hung in the mold frame, while 570g of silicone rubber (a product of Toray Silicon K. K., Japan sold under a trade name of "SH-9551 RTV") and 57g of a hardening agent (a product of Toray Silicon K. K., Japan) were mixed by agitation, poured into the mold frame, and hardened to obtain the rubber mold.

46g of pouring liquid acrylic resin (a product of K. K. Matsumoto Kosho, Japan sold under a trade name "VISPOT") and 4.6g of a hardening agent (also a product of K. K. Matsumoto Kosho, Japan) were mixed by agitation, and poured into the abovementioned rubber mold produced beforehand at places corresponding to the pellets portion. A blank tool body without the pellets provided thereon was then placed in the mold in a manner pressing it against the mold surface, and the resin was hardened at a room temperature for about 20 to 30 minutes, and then the tool body was removed from the rubber mold. It was almost unnecessary to correct the curvature of the pellet surface of the lapping tool thus obtained, exhibited the completed tool sufficient stability at a working test.

In place of the liquid acrylic resin and the hardening agent as used above, methyl methacrylate of Wako Junyaku K. K., Japan and a hardening agent, "AZOBIS" of Tokyo Kasei Kogyo K. K., Japan have been used. The results obtained were substantially same.

EXAMPLE 3

In the same manner as in Example 1 above, liquid polyethylene terephthalate resin (a product of Nippon Shokubai Kogyo K. K., sold under a trade name of "EPOLAC") and a hardening agent (a product of Nippon Shokubai Kagaku Kogyo K. K. sold under a trade name of "CATALIST-M") were used in place of the liquid epoxy resin PRIEPOH PE-10 and the amine type hardening agent T.T.A. to manufacture the lapping dish. The thus obtained lapping tool required hardly any curvature correction of the pellet surface by a correcting tool.

EXAMPLE 4

The master lapping tool and the silicone rubber mold were first produced in the same manner as in Example 1 above.

Subsequently, 100g of polyurethane elastomer (a product of E. I. Du pont de Nemours & Co., U. S. A. sold under a trade name "ADIPRENE L315") was heated to a temperature of about 80° C, to which 29g of a hardening agent molten at 120° C (a product of Wakayama Seika K. K., Japan sold under a trade name "MOCO") was added and mixed, followed by further addition thereto of 20g of cerium oxide ($CeO_2$), or zirconium oxide ($ZrO_2$), and mixing by a mixer. Following the mixing, 5g of a foaming agent (a product of Toray Silicon K. K., Japan sold under a trade name "Toray Sillicon SH190") and 0.5g of water were added to the mixture in sequence and the whole batch was subjected to a high speed agitation.

The thus prepared liquid polyurethane resin composition was then poured into the rubber mold previously produced at place corresponding to the pellets portion. Then, a blank tool body having no pellets provided thereon and having the same curvature as that of the master was press-contacted from above onto the mold surface and kept in an isothermal chamber at 70° to 80° C for 30 minutes to harden the resin composition. Upon sufficient hardening, the lapping tool was removed from the mold.

The adhesion of the pellets onto the body of the lapping tool was found very strong, and none of them peeled off during polishing of the lens.

For the purpose of comparison, a foamed polyurethane sheet was cut into pieces to make the pellets and the latter were stuck onto the surface of the body of the lapping tool by the conventional method. This lapping tool necessitated polishing for about 2 to 5 minutes by a correcting tool of cast iron to correct the surface curvature, although the lapping tool according to the present invention was perfectly corrected in about 10 to 30 seconds.

In the above-described pellet production, "ADIPRENE L315" has been substituted for "CORONATE" (a trade name of a product made and sold by Nippon Polyurethane K. K., Japan) as the polyurethane elastomer, and results substantially similar to the above were obtained.

EXAMPLE 5

In Example 1 above, aluminum was used in place of the rubber material, and was machined to form a shaping mold in concave-to-convex relationship with the master lapping dish. The portion corresponding to the pellets in this mold was then coated with a silicon type mold separating agent (a product of Fuji Kobunshi Kogyo K. K., Japan sold under a trade name "AIR-LEASE"). Subsequently, the liquid epoxy resin "PRIEPOH PE-10" was poured into the aluminum mold at places corresponding to the pellet portions, and then a blank tool body without pellets provided thereon was press-contacted from above to the mold surface to harden the resin in exactly the same way as done in Example 1. Upon sufficient hardening, the lapping tool was removed from the mold. The thus obtained lapping tool exhibited the exactly same performance as that of Example 1.

Although the aluminum mold used in this example is expensive in manufacturing cost in comparison with the silicone rubber mold, it is superior in its durability, hence it renders perfect services for the production of lapping tool according to the present invention.

The expression "concave-to-convex" used to describe the relationship of the master lapping tool to the mold made from it is used in a sense broad enough to apply both to convex lapping tools such as the lapping tool 1 of FIG. 2 and concave lapping tools such as the lapping tool 1 of FIG. 3.

I claim:

1. A method for manufacturing a lapping tool for grinding or polishing glass comprising a metallic tool body and a plurality of synthetic resin pellets joined to said body on its surface, which method comprises the steps of:

a. providing a convex or concave shaping mold containing pellet cavity portions which have an adhesive-free property relative to hardened casting resin;

b. pouring a liquid resin selected from the group consisting of liquid epoxy resin, liquid polyurethane resin, liquid acrylic resin, and liquid polyethylene terephthalate, into said mold in a quantity sufficient to fill only the pellet cavity portions therein;

c. hardening the liquid resin in said pellet cavity portions of said mold while press-contacting therewith a metallic blank lapping tool body corresponding in size and shape to said mold, said blank tool body being of a metallic material to which said resin adheres at least after the resin hardens, and d. thereafter removing the lapping tool with the pellets adhering thereto from said mold.

2. The method for manufacturing the lapping tool according to claim 1, wherein the material for the mold is silicone rubber.

3. The method for manufacturing the lapping tool according to claim 1, wherein the material for the mold is a metal and at least the portions in the mold corresponding to the pellets are coated with a mold separating agent.

4. The method for manufacturing the lapping tool according to claim 3, wherein the mold separating agent is a silicon type mold separating agent.

5. The method for manufacturing the lapping tool according to claim 3, wherein the mold separating agent is a fluorinated hydrocarbon type mold separating agent.

6. The method for manufacturing the lapping tool according to claim 1, wherein the blank tool body is of cast iron.

* * * * *